US006073367A

United States Patent [19]

McKenzie et al.

[11] Patent Number: 6,073,367

[45] Date of Patent: *Jun. 13, 2000

[54] FLOOR SWEEP ASSEMBLY FOR A GRAIN DRYER HAVING SUPPORT MEMBERS AND WIPERS WHICH ARE SPACED APART FROM EACH OTHER BY SPACING MEMBERS AT INTERSECTIONS FORMED THEREBETWEEN

[75] Inventors: Terry L. McKenzie; Paul W. Peterson, both of Indianapolis; Wesley L. Peterson, DeMotte, all of Ind.

[73] Assignee: ffi Corporation, Indianapolis, Ind.

[ * ] Notice: This patent is subject to a terminal disclaimer.

[21] Appl. No.: 09/124,307

[22] Filed: Jul. 29, 1998

Related U.S. Application Data

[60] Provisional application No. 60/054,171, Jul. 30, 1997.

[51] Int. Cl.[7] ..... F26B 7/00

[52] U.S. Cl. ..... 34/381; 34/386; 34/166; 34/173

[58] Field of Search ..... 34/359, 360, 366, 34/367, 368, 369, 371, 380, 381, 386, 397, 400, 165, 166, 167, 172, 173, 179; 414/294, 301, 305, 306, 307, 308, 309, 313, 326, 808

[56] References Cited

U.S. PATENT DOCUMENTS

| | | | |
|---|---|---|---|
| 3,713,564 | 1/1973 | Cottrell . | |
| 3,833,137 | 9/1974 | Mathews . | |
| 4,004,351 | 1/1977 | Sanneman et al. | 34/168 X |
| 4,020,561 | 5/1977 | Mathews . | |
| 4,183,430 | 1/1980 | Hunter . | |
| 4,189,262 | 2/1980 | Anderson . | |
| 4,217,701 | 8/1980 | Mathews . | |
| 5,039,827 | 8/1991 | Harmon . | |
| 5,566,470 | 10/1996 | Morrison | 34/167 |
| 5,860,221 | 1/1999 | Morrison et al. | 34/167 X |

OTHER PUBLICATIONS

Marketing brochure from Grain Systems, Inc., 1004 E. Illinois Street, Assumption, IL 62510, Published prior to Jul. 30, 1997.

Marketing brochure from Kan–Sun ® Grain Dryers, Mathews Company, Crystal Lake, IL 60014, Published prior to Jul. 30, 1997.

Marketing pamphlet entitled "Unparalleled Accu–trol metering", by Zimmerman a Division of ffi Corporation, 5900 Elmwood Ave., Indianapolis, Indiana 46203–6086 Published prior to Jul. 29, 1998.

Blueprint entitled, "Installing Drives & Metering Screws", Published prior to Jul. 30, 1997.

Blueprint entitled, "Typical Metering Mechanism", Published prior to Jul. 30, 1997.

Blueprint entitled, "Idler Gear Positioning", Published prior to Jul. 30, 1997.

(List continued on next page.)

*Primary Examiner*—Stephen Gravini
*Attorney, Agent, or Firm*—Maginot, Addison & Moore

[57] ABSTRACT

A grain dryer includes a wall assembly having (i) an inner wall and an outer wall which defines a grain flow path therebetween, and (ii) a discharge slot defined in the wall assembly through which grain may flow. The grain dryer also includes a grain shelf floor positioned relative to the wall assembly such that grain flowing through the discharge slot advances onto the grain shelf floor. The grain dryer further includes a floor sweep assembly positioned vertically above the grain shelf floor, the floor sweep assembly having (i) a support member, and (ii) a wiper positioned relative to the support member such that, when the floor sweep assembly is viewed in a plan view, the support member defines an intersection with the wiper. The grain dryer also includes a motor for rotating the floor sweep assembly about a central axis. In addition, the grain dryer includes a spacer attached to both the support member and the wiper in a manner which causes the support member to be spaced apart from the wiper. A method of advancing grain in a grain dryer with a floor sweep assembly is also disclosed.

25 Claims, 10 Drawing Sheets

OTHER PUBLICATIONS

Blueprint entitled, "Grain Discharge Metering Mechanism", Published prior to Jul. 30, 1997.

Marketing brochure entitled "Zimmerman: The Innovator of Time–Proven Commercial Grain Dryers", printed on Mar. 1996 by Zimmerman a Division of ffi Corporation, 5900 Elmwood Ave., Indianapolis, Indiana 46203–6086.

Marketing brochure entitled "Zimmerman: The Innovator of Time–Proven Commerical Grain Dryers", printed on Dec. 1997 by Zimmerman a Division of ffi Corporation, 5900 Elmwood Ave., Indianapolis, Indiana 46203–6086.

FLOOR SWEEP ASSEMBLY FOR A GRAIN DRYER HAVING SUPPORT MEMBERS AND WIPERS WHICH ARE SPACED APART FROM EACH OTHER BY SPACING MEMBERS AT INTERSECTIONS FORMED THEREBETWEEN

This Appln. claims benefit of Provisional Appln. 60/054, 171 Jul. 30, 1997.

Cross reference is made to copending U.S. patent applications Ser. No. 09/124,308 (Attorney Docket No. 1571-0001), entitled "Floor Sweep Assembly for a Grain Dryer having Primary Support Members and Ancillary Support Members which Form a Number of Intersections with a Wiper" by Terry L. McKenzie, Paul W. Peterson, and Wesley L. Peterson, and Ser. No. 09/124,306 (Attorney Docket No. 1571-0003), entitled "Grain Dryer having Motor for Rotating Floor Sweep Assembly which is Mounted Above Cooling Floor" by Terry L. McKenzie, Paul W. Peterson, and Wesley L. Peterson, and Ser. No. 09/124,305 (Attorney Docket No. 1571-0004), entitled "Wiper for a Floor Sweep Assembly of a Grain Dryer which includes Ultra-High Molecular Weight Resin which Contacts Grain and Grain Shelf Floor During Rotation Thereof" by Terry L. McKenzie, Paul W. Peterson, and Wesley L. Peterson, all of which are assigned to the same assignee as the present invention, and all of which are filed concurrently herewith.

BACKGROUND OF THE INVENTION

The present invention relates generally to grain dryers which utilize heated air to reduce the moisture content of harvested grain such as corn, beans, wheat, and oats.

In order to store grain for a long period of time, it is necessary to dry the grain to a condition in which it is less subject to molding or other deterioration. Accordingly, numerous types of grain dryers have heretofore been designed which possess a number of grain flow channels defined between a pair of perforated walls. Grain is advanced through these grain flow channels while at the same time heat is passed through the perforated walls. This process results in heating of the grain which is flowing through the grain flow channels thereby reducing the moisture content of the grain. Reducing the grain's moisture content enables the grain to be stored for a long period of time without molding or otherwise deteriorating.

Defined within the lower portion of the perforated walls of the above type of grain dryer, there exists a number of discharge slots through which grain advances after being subjected to the above-described moisture reduction process. One type of grain dryer which has heretofore been designed provides a grain shelf floor which receives the grain flowing out through the discharge slots. The grain shelf floor has a hopper opening defined in a center portion of the grain shelf floor. Thereafter, a grain metering system which includes a number of augers advances the grain from the outer portion of the grain shelf floor to the hopper opening. Once the grain reaches the hopper opening, the grain falls into a discharge hopper located under the hopper opening. The discharge hopper directs the grain to a discharge auger thereby removing the grain from the grain dryer.

One challenge when designing grain dryers is to obtain a grain metering system which is durable yet relatively inexpensive to manufacture. Another challenge when designing grain dryers is to obtain a grain metering system which accurately meters the grain into the discharge hopper at a desired rate. Yet another challenge when designing grain dryers is to obtain a grain metering system which has a relatively low horsepower requirement for the motor of the grain metering system. In addition, another challenge when designing grain dryers is to obtain a grain metering system that protects the motor of the grain metering system from being contaminated by grain dust. Still another challenge when designing grain dryers is to obtain a grain metering system which does not cause damage to the grain as the grain is metered into the discharge hopper. Yet another challenge when designing grain dryers is to obtain a grain metering system which does not cause damage to the grain shelf floor during operation of the grain metering system.

SUMMARY OF THE INVENTION

According to one embodiment of the present invention, there is provided a floor sweep assembly for a grain dryer. The floor sweep assembly includes a framework which is rotatable around a central axis. The floor sweep assembly further includes a wiper positioned relative to the framework such that, when the floor sweep assembly is viewed in a plan view, the framework defines a first intersection with the wiper. Moreover, the floor sweep assembly includes a first spacer attached to both the framework and the wiper in a manner which causes the framework to be spaced apart from the wiper.

According to another embodiment of the present invention, there is provided a floor sweep and motor assembly for a grain dryer which includes a motor a support member which is driven by the motor. The grain dryer further includes a wiper positioned relative to the support member such that, when the support member and the wiper are viewed in a plan view, the support member defines an intersection with the wiper. Also, the grain dryer includes a spacer attached to both the support member and the wiper in a manner which causes the support member to be spaced apart from the wiper.

Yet according to another embodiment of the present invention, there is provided a method of advancing grain in a grain dryer with a floor sweep assembly, with (i) the floor sweep assembly including a support member and a wiper, and (ii) the wiper being positioned relative to the support member such that, when the floor sweep assembly is viewed in a plan view, the support member defines an intersection with the wiper. The method includes the steps of (i) rotating the floor sweep assembly so that the support member and the wiper are rotated in a path of movement, and (ii) maintaining a space between the support member and the wiper at the intersection such that no portion of the wiper contacts the support member during the rotating step.

According to yet another embodiment of the present invention, there is provided a floor sweep assembly for a grain dryer. The grain dryer includes a framework which is rotatable around a central axis, wherein the framework includes (i) a first primary support member which extends radially outwardly relative to the central axis, (ii) a second primary support member which extends radially outwardly relative to the central axis, and (iii) an ancillary support member which is spaced apart from the central axis and extends between the first primary support member and the second primary support member. The grain dryer further includes a wiper positioned relative to the framework such that, when the floor sweep assembly is viewed in a plan view, the framework and the wiper define (i) a primary intersection of the wiper and the first primary support member, and (ii) an ancillary intersection of the wiper and the ancillary support member. In addition, the grain dryer includes a first spacer attached to the first primary support member and the wiper in a manner which causes the first primary support member to be spaced apart from the wiper. The grain dryer further includes a second spacer attached to the ancillary support member and the wiper in a manner which causes the ancillary support member to be spaced apart from the wiper.

According to still another embodiment of the present invention, there is provided a grain dryer which includes a wall assembly having (i) an inner wall and an outer wall which defines a grain flow path therebetween, and (ii) a discharge slot defined in the wall assembly through which grain may flow. The grain dryer further includes a grain shelf floor positioned relative to the wall assembly such that grain flowing through the discharge slot advances onto the grain shelf floor. The grain dryer additionally includes a floor sweep assembly positioned vertically above the grain shelf floor, the floor sweep assembly having (i) a support member, and (ii) a wiper positioned relative to the support member such that, when the floor sweep assembly is viewed in a plan view, the support member defines an intersection with the wiper. Moreover, the grain dryer includes a motor for rotating the floor sweep assembly about a central axis. The grain dryer additionally includes a spacer attached to both the support member and the wiper in a manner which causes the support member to be spaced apart from the wiper.

One object of the present invention is to provide a new and useful grain dryer.

Another object of the present invention is to provide an improved grain dryer.

Still another object of the present invention is to provide a new and useful floor sweep assembly for a grain dryer.

Yet another object of the present invention is to provide an improved floor sweep assembly for a grain dryer.

Still another object of the present invention is to provide a new and useful method of advancing grain across a grain shelf floor of a grain dryer with a floor sweep assembly.

Another object of the present invention is to provide an improved method of advancing grain across a grain shelf floor of a grain dryer with a floor sweep assembly.

Yet another object of the present invention is to provide a floor sweep assembly which is durable yet relatively inexpensive to manufacture.

Still another object of the present invention is to provide a floor sweep assembly which accurately meters the grain into the discharge hopper at a desired rate.

Yet another object of the present invention is to provide a floor sweep assembly which rotates easily during operation of the grain dryer thereby placing a relatively low horsepower requirement on the motor of the grain metering system of the grain dryer.

Still another object of the present invention is to provide a grain dryer that protects the motor of the grain metering system of the grain dryer from being contaminated by grain dust.

Yet another object of the present invention is to provide a floor sweep assembly which does not cause damage to the grain as the grain is metered into the discharge hopper.

Still another object of the present invention is to provide a floor sweep assembly of a grain metering system which does not cause damage to the grain shelf floor during operation of the grain metering system.

Other objects and benefits of the present invention can be discerned from the following description and accompanying drawings.

DESCRIPTION OF THE PREFERRED EMBODIMENT

Figure 1:
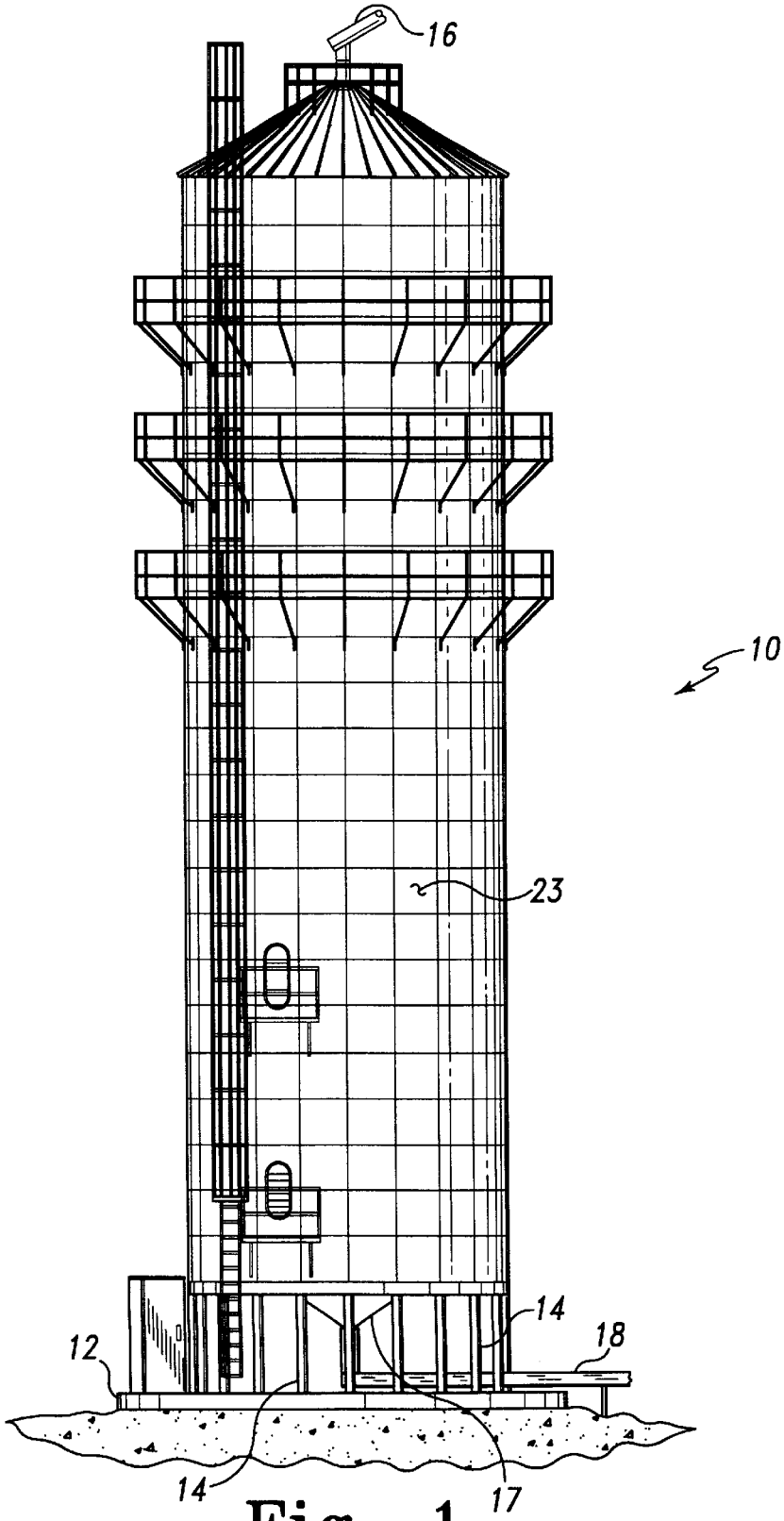
FIG. 1 is a side elevational view of a grain dryer which incorporates the features of the present invention therein.

For the purposes of promoting an understanding of the principles of the invention, reference will now be made to the embodiments and methods illustrated in the drawings and specific language will be used to describe the same. It will nevertheless be understood that no limitation of the scope of the invention is thereby intended, such alterations and further modifications in the illustrated devices and methods, and such further applications of the principles of the invention as illustrated therein being contemplated as would normally occur to one skilled in the art to which the invention relates.

Referring now to the drawings, FIG. 1 shows a grain dryer 10 which is supported on a concrete pad 12. The grain dryer 10 includes a number legs 14 which extend into the concrete pad 12. The grain dryer further includes an inlet conduit 16, a hopper 17, and an outlet conduit 18. Grain is advanced into the grain dryer 10 through the inlet conduit 16. Thereafter, grain advances through the grain dryer 10 where it is heated to reduce its moisture content. After the grain's moisture content is reduced, the grain is advanced into the hopper 17 and out of the grain dryer through the outlet conduit 18 thereby allowing it to be received for long term storage in a storage unit such as a silo. Types of grain which may be dried by dryer 10 include corn, beans, wheat, and oats.

Figure 2:
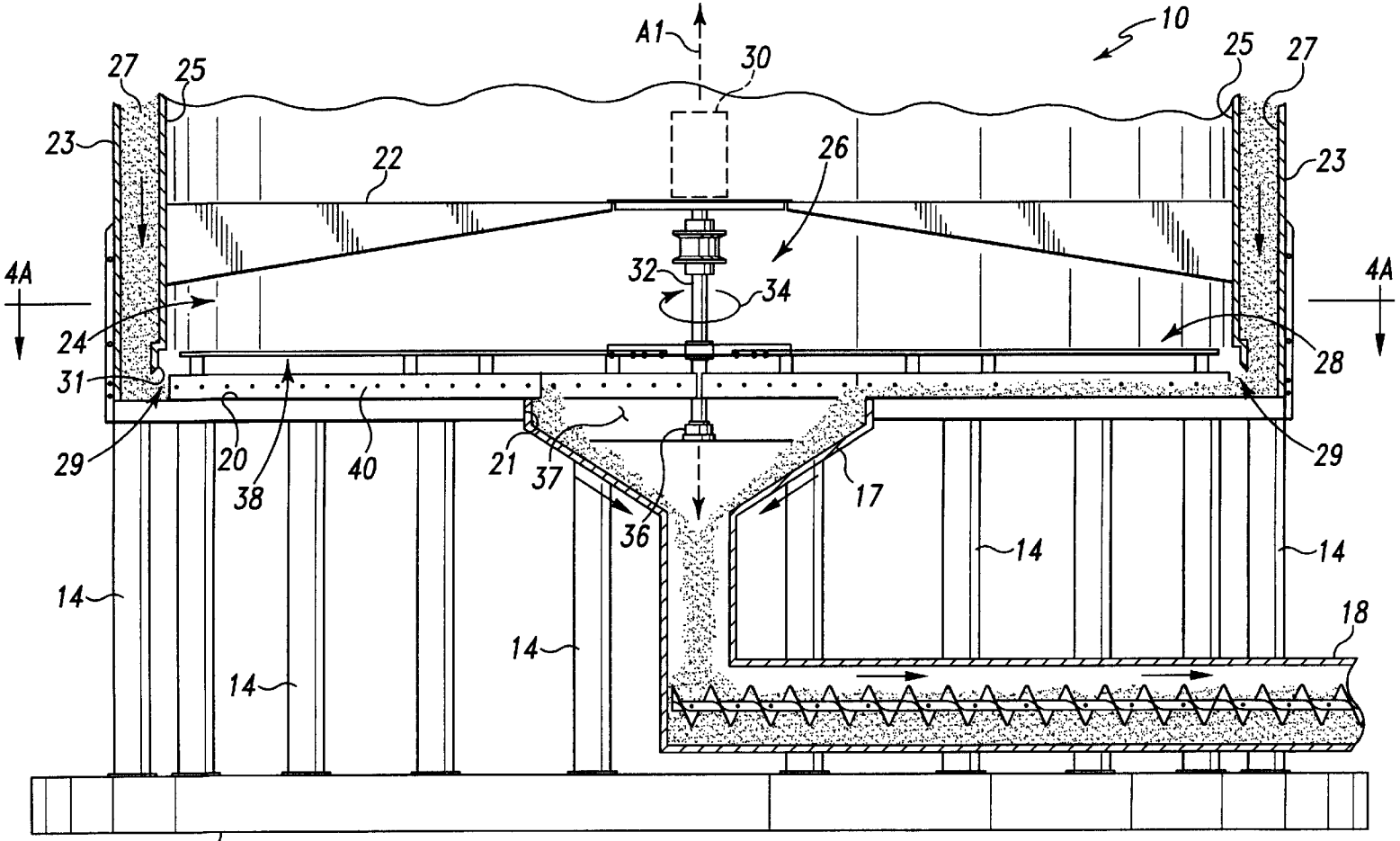
FIG. 2 is a cross sectional view of a lower portion of the grain dryer of FIG. 1.
Figure 3:
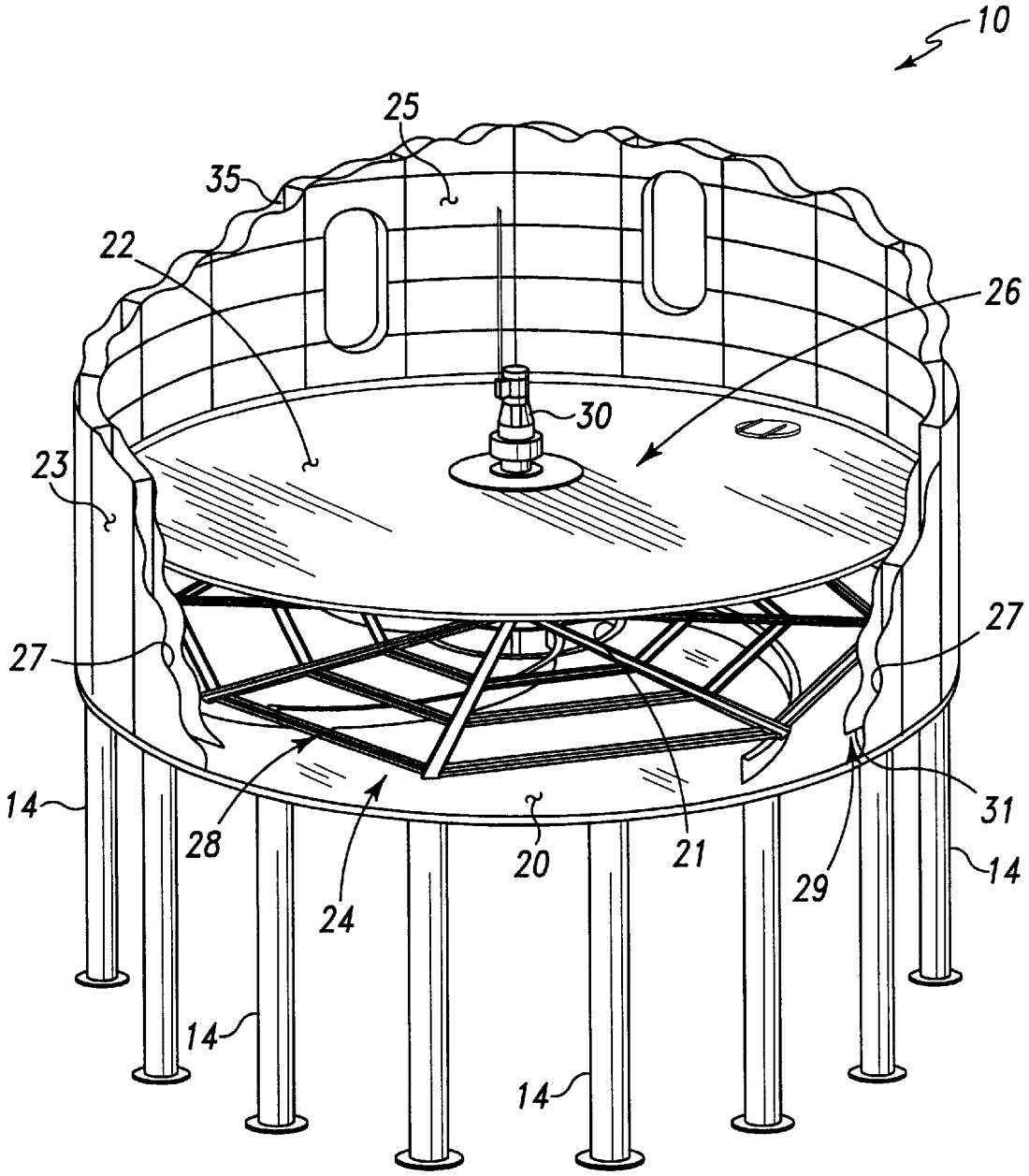
FIG. 3 is a fragmentary perspective view of a lower portion of the grain dryer of FIG. 1.
Figure 5:
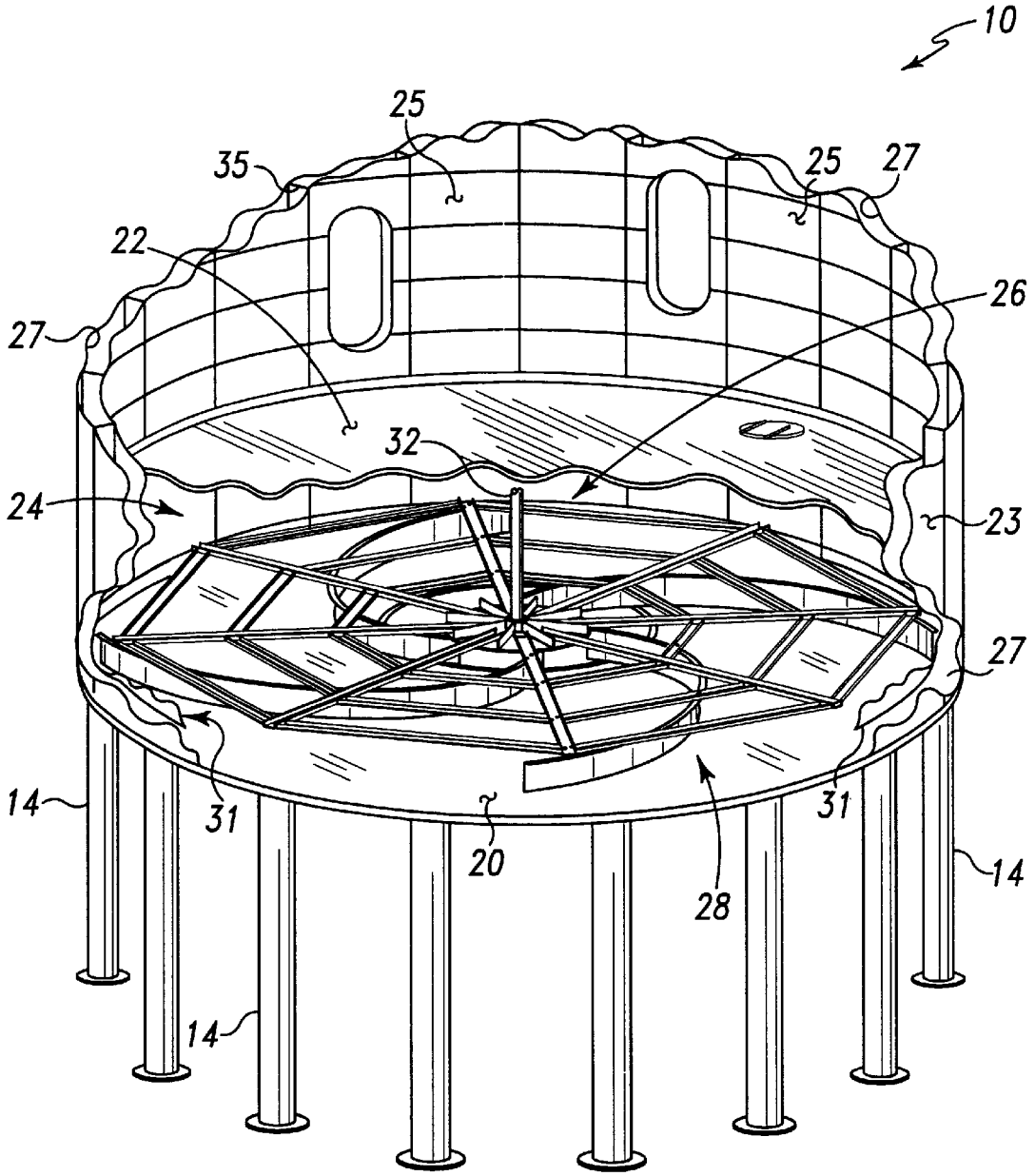
FIG. 5 is a view similar to FIG. 3 but showing a portion of the cooling floor and additional portions of the inner and outer perforated walls of the grain dryer removed for clarity of description.

Turning now to FIGS. 2, 3, and 5, a lower portion of the grain dryer 10 is shown in more detail. The grain dryer 10 includes a grain shelf floor 20 and a cooling floor 22 which define a sweep space 24 therebetween. The cooling floor 22 is positioned vertically above the grain shelf floor 20. The grain shelf floor 20 is circular in shape and is positioned in a substantially horizontal orientation. Similarly, the cooling floor 22 is circular in shape and is positioned in a substantially horizontal orientation. In addition, the cooling floor 22 is positioned in a substantially parallel orientation in relation to the grain shelf floor 20. Both the grain shelf floor 20 and the cooling floor 22 are made from galvanized sheet steel. A hopper opening 21 is defined in a center portion of the grain shelf floor 20.

The grain dryer 10 further includes an outer wall 23 and an inner wall 25 which collectively define a number of grain flow channels or paths 27 therebetween. A number of partitions 35 define the lateral sides of the grain flow channels 27. Both the outer wall 23 and the inner wall 25 are perforated as is well known in the art in order to allow heated air to traverse the grain flow channels 27 and heat the grain flowing therein. The space defined by the grain flow channels 27 constitutes a drying space in which the grain traveling through this space is dried (i.e. its moisture content is reduced).

A grain discharge slot 29 is defined between a lower end 31 of the inner wall 25 and the grain shelf floor 20 as shown in FIGS. 2, 3, and 5. After dried grain reaches the lower end of the grain flow channels 27, it exits the grain discharge slot 29 and is advanced onto an outer peripheral portion of the grain floor shelf 20 as shown in FIG. 2. Thereafter, a grain metering system 26 transports the grain from the outer peripheral portion of the grain shelf floor 20 to the hopper opening 21 defined in the center portion of the grain shelf floor 20.

A grain metering system 26 is positioned in the lower portion of the grain dryer 10. In particular, the grain metering system 26 includes a floor sweep assembly 28 which is located within the sweep space 24. The grain metering system further includes a motor 30 which has a drive shaft 32 which is mechanically coupled to the floor sweep assembly 28. Operation of the motor 30 results in clockwise rotation of drive shaft 32 (indicated by arrow 34 in FIG. 2). The drive shaft 32 extends downwardly from the motor 30 through the hopper opening 21 and terminates in a lower end portion 36 which is supported by a support bar 37 which is mounted within the hopper 17. The lower end portion 36 of the drive shaft 32 is located vertically below the grain shelf floor 20.

The motor 30 illustratively includes an electric motor and a Sumitomo Machinery Corporation of America SM-CYCLO® speed reducer assembly. This combination provides substantial speed reduction in a relatively small package. It is designed to reduce substantially the likelihood of a catastrophic failure, and to withstand substantial shock loads. The flexibility provided by the number of different gear ratios available for this style motor permits its use with a number of different dryer sizes and unloading speed specifications. The motor's power supply (not shown) is also continuously monitored, providing additional protection against overloading. A Browning GRID-FLEX™ coupling located between the drive shaft 32 and the floor sweep assembly 28 accommodates minor misalignment of the motor 30 and the floor sweep assembly 28, and permits the floor sweep assembly 28 to "float" on the grain shelf floor 20.

The motor 30 is mounted on the cooling floor 22 at a position vertically above the cooling floor 22 as shown in FIGS. 2 and 3. With this mounting arrangement, the motor 30 is located out of the sweep space 24. It should be appreciated that the sweep space 24 is a relatively small confined space whose ambient air possesses a relatively high concentration of grain dust. This grain dust is mixed into the ambient air when the grain exits the grain flow channels 27 through the grain discharge slot 29, as well as when the grain is metered by the floor sweep assembly 28 horizontally along the grain shelf floor 20 and into the hopper 17. Isolation of the motor 30 from the highly grain dust concentrated ambient air of the sweep space 24 results in enhanced operation and longevity of the motor 30. In addition, mounting of the motor 30 in the above-described manner positions the motor 30 in a region which is subjected to relatively cool recirculating air during operation of the grain dryer 10. This results in cooling of the motor 30 during its operation.

Figure 4A:
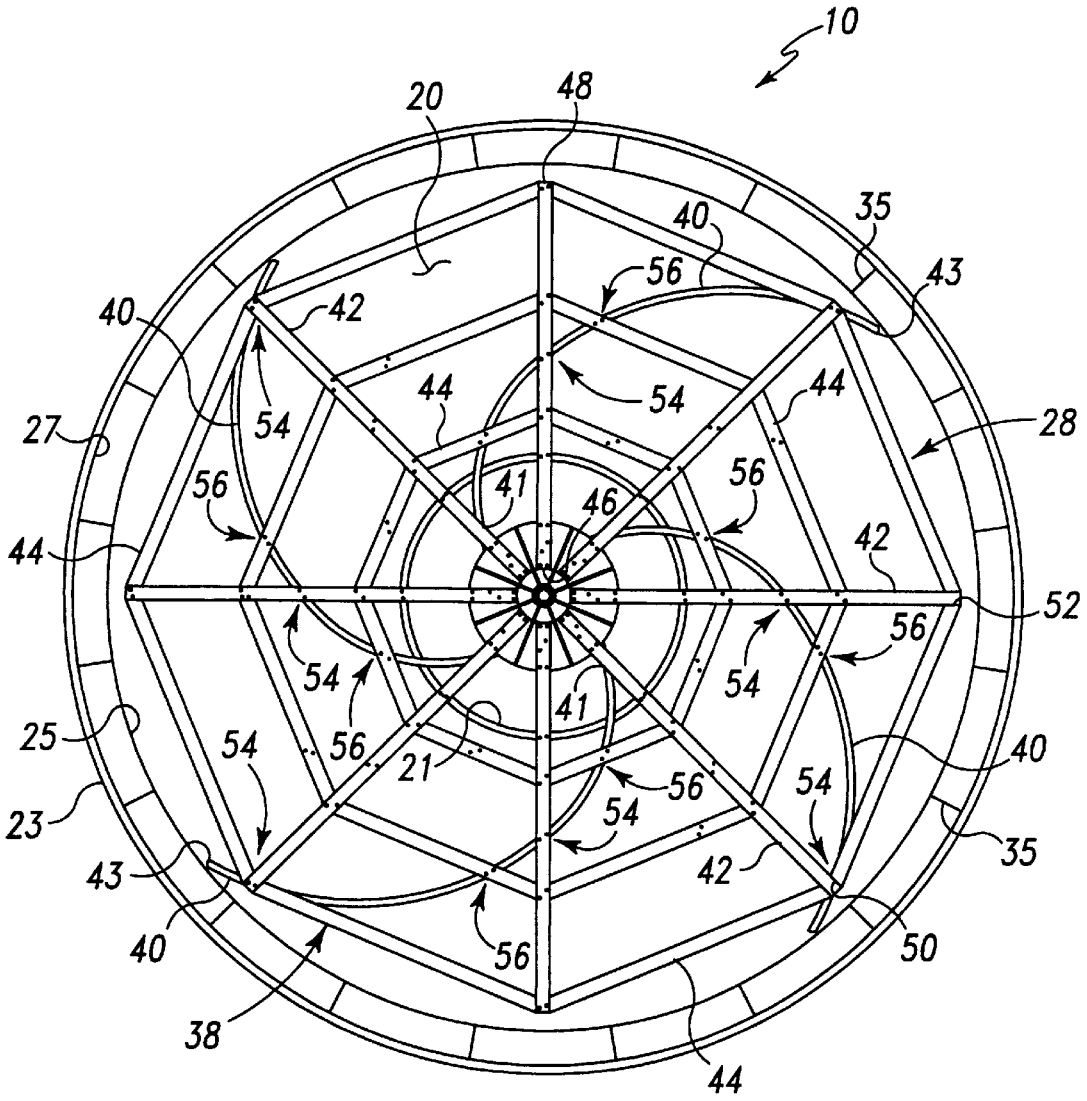
FIG. 4A is a sectional view which is taken along the line 4A—4A of FIG. 2 as viewed in the direction of the arrows, with FIG. 4A showing a plan view (or top elevational view) of a first embodiment of the floor sweep assembly of the present invention.
Figure 6A:
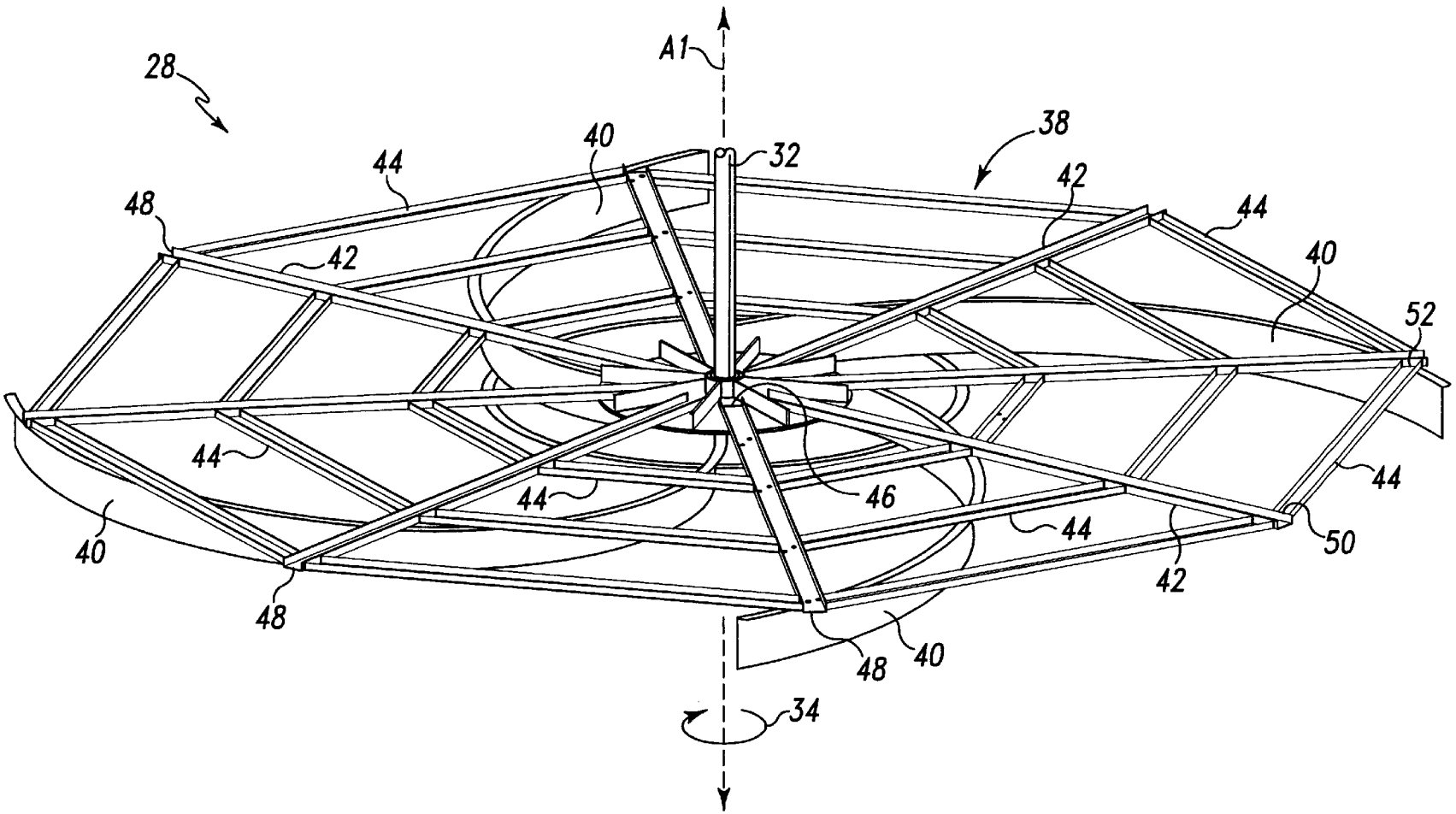
FIG. 6A is a perspective view of the first embodiment of the floor sweep assembly of the grain dryer of FIG. 1.

Referring now to FIGS. 4A and 6A, the floor sweep assembly 28 is shown in more detail. The floor sweep assembly 28 is rotatable around a central axis A1 (see FIG. 6A) after it is installed into the grain dryer 10. In particular, the drive shaft 32 of the motor 30 is mechanically coupled to the floor sweep assembly 28. During operation of the grain dryer 10, the motor 30 is driven to rotate the drive shaft 32. Rotation of the drive shaft 32 causes rotation of the floor sweep assembly 28 around the central axis A1 in the clockwise direction 34 as shown in FIG. 2.

The floor sweep assembly 28 includes a framework 38 and a number of wipers 40 each of which is secured to the framework 38. The framework 38 includes a number of primary support members 42 and a number of ancillary support members 44. Each of the primary support members 42 extend radially outwardly relative to the central axis A1 as shown in FIG. 4A. Moreover, each of the ancillary support members 44 is spaced apart from the central axis A1 and extends between a first primary support member 42 and an adjacent second primary support member 42 as shown in FIGS. 4A and 6A.

During operation of the grain dryer 10, the motor 30 is driven to rotate the floor sweep assembly 28 around the central axis A1 in the clockwise direction 34 as shown in FIG. 2. More specifically, the motor 30 is driven so as to rotate the drive shaft 32. Rotation of the drive shaft 32 causes rotation of the framework 28, which in turn cause rotation of the wipers 40 in a recirculating path of movement. Rotation of the wipers 40 in the above manner causes grain positioned on the grain shelf floor 20 to be pushed in a substantially horizontal direction across an upper surface of the grain shelf floor 20 by the wipers 40 until the grain falls through the hopper opening 21.

Each of the primary support members 42 has an inboard primary support end 46 and an outboard primary support end 48. Each of the ancillary support members 44 has a left lateral end 50 and a right lateral end 52.

Each of the wipers are secured to the framework 38 such that, when the floor sweep assembly 38 is viewed in a plan view such as in FIG. 4A, the framework 38 and the wipers 40 define a number of primary intersections 54 of the wipers 40 and the primary support members 42. The primary intersections 54 occur at locations which are interposed between inboard wiper ends 41 of the wipers 40 and outboard wiper ends 43 of the wipers 40 as shown in FIG. 4A. In addition, each of the wipers 40 are further secured to the framework 38 such that, when the floor sweep assembly 38 is viewed in the plan view as in FIG. 4A, the framework 38 and the wipers 40 define a number of ancillary intersections 56 of the wipers 40 and the ancillary support members 44. It should be noted that the primary intersections 54 and the ancillary intersection 56 provide convenient locations to secure the wipers 40 to the framework 38. Providing the floor sweep assembly 28 with a substantial number of these intersections 54, 56, results in a floor sweep assembly which is highly stable during operation of the grain dryer 10, as well as highly durable over the life span of the grain dryer.

It should be appreciated that providing the floor sweep assembly 28 with intersections that occur at locations which involve more than one primary support member (e.g. two primary support members) contributes to the above-identified stability and durability. Moreover, providing the floor sweep assembly 28 with intersections that occur at locations which involve at least one primary support member and at least one ancillary support member also contribute to the above-identified stability and durability.

Figure 4B:
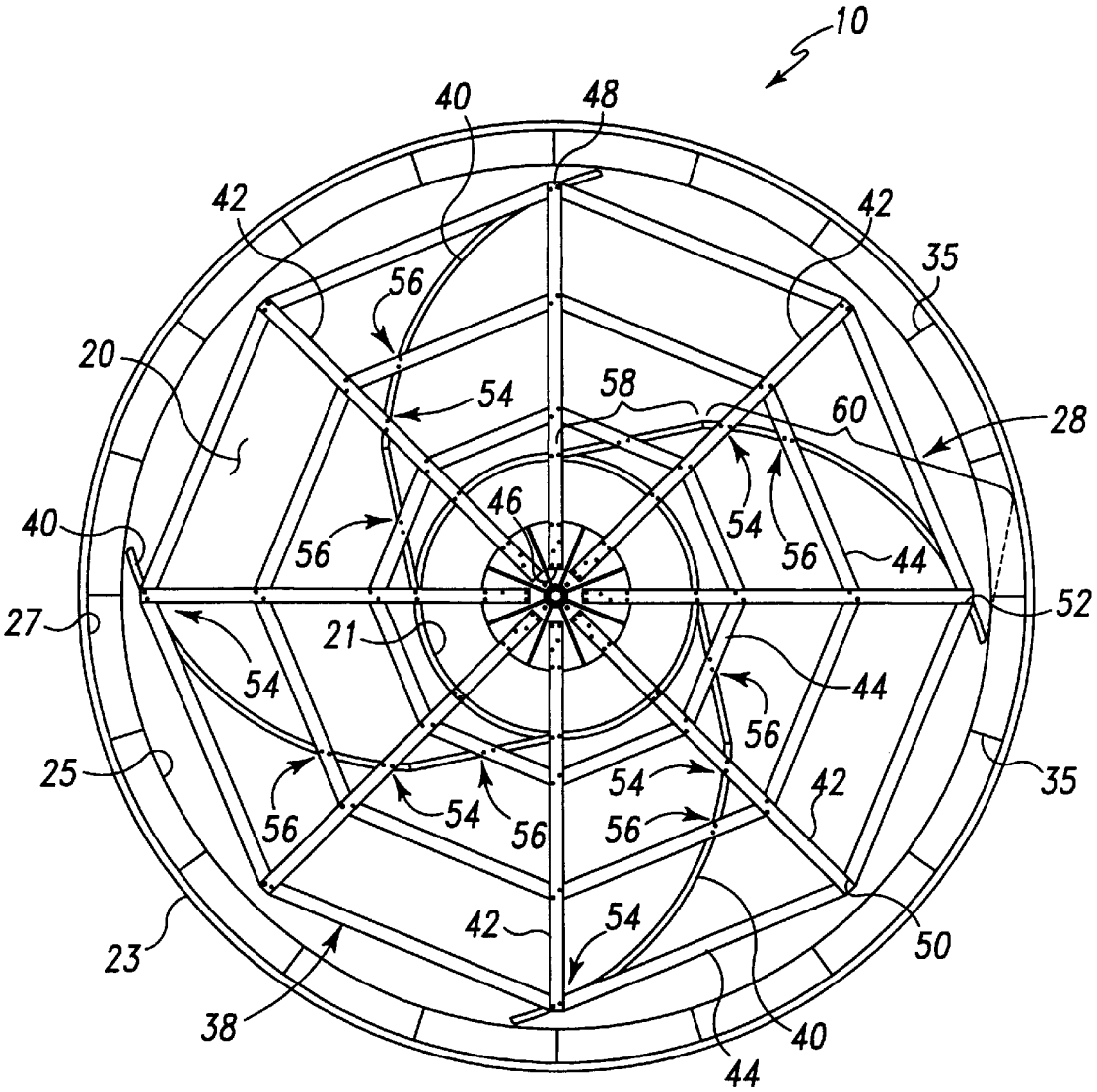
FIG. 4B is a view similar to FIG. 4A but with FIG. 4B showing a plan view (or top elevational view) of a second embodiment of the floor sweep assembly of the present invention.

FIG. 4B shows a second embodiment of the floor sweep assembly 28 which incorporates the features of the present invention therein. Reference numbers which were used to identify the various elements in FIG. 4A will be used to identified analogous elements in FIG. 4B for clarity of description. The floor sweep assembly 28 of FIG. 4B is similar to the floor sweep assembly 28 of FIG. 4A, however, one distinction exists which relates to the geometric configuration of the blades 40. In particular, each of the wipers 40 of FIG. 4A gradually curves throughout its entire length. In contrast, the wipers 40 of FIG. 4B include a linear section 58 and a curved section 60. The linear section 58 is located at an inboard portion of each wiper 40, while the curved section 60 is located at an outboard portion of each wiper 40. Another distinction between the floor sweep assembly 28 of FIG. 4A and the floor sweep assembly 28 of FIG. 4B is that the inboard portion of wipers 40 of FIG. 4B terminates near the outer peripheral edges of hopper opening 21, while the inboard portion of wipers 40 of FIG. 4A terminates a significant distance inward of the outer peripheral edges of hopper opening 21.

Figure 6B:
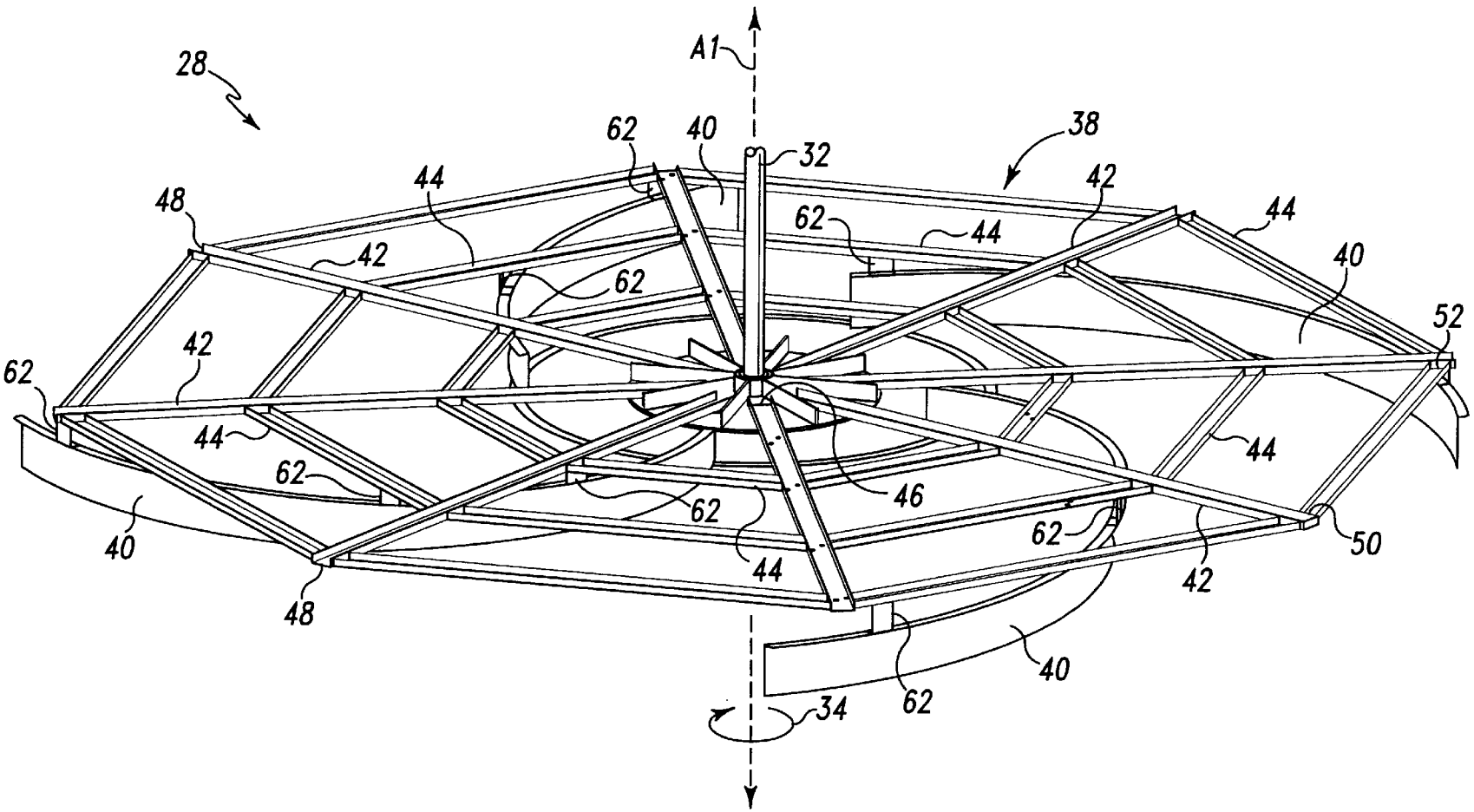
FIG. 6B is a view similar to FIG. 6A but showing a third embodiment of the floor sweep assembly of the present invention.

FIG. 6B shows a third embodiment of the floor sweep assembly 28 which incorporates the features of the present invention therein. Reference numbers which were used to identified the various elements in FIG. 4A will be used to identify analogous elements in FIG. 6B for clarity of description. The floor sweep assembly 28 of FIG. 6B is similar to the floor sweep assembly 28 of FIG. 4A, however, one distinction which exists is that the floor sweep assembly 28 of FIG. 6B includes a number of spacers 62 which are interposed between the framework 38 and the wipers 40 at various of the intersections 54, 56. Each of the spacers 62 is generally U-shaped and includes a number of fastener apertures 64 extending therethrough (see also FIGS. 9 and 10). In addition, each of the spacers 62 includes an upright wall 66 having a height of H1. Preferably, the height H1 is equal to about two inches (2") or greater. More preferably, the height H1 is equal to about four inches (4"). Thus, the closest distance between the framework 38 and any of the wipers 40 is about two inches (2") or greater. And preferably, the closest distance between the framework 38 and any of the wipers 40 is about four inches (4"). Thus, during operation of the grain dryer 10, no portion of any of the wipers 40 contacts the framework 38.

Figure 9:
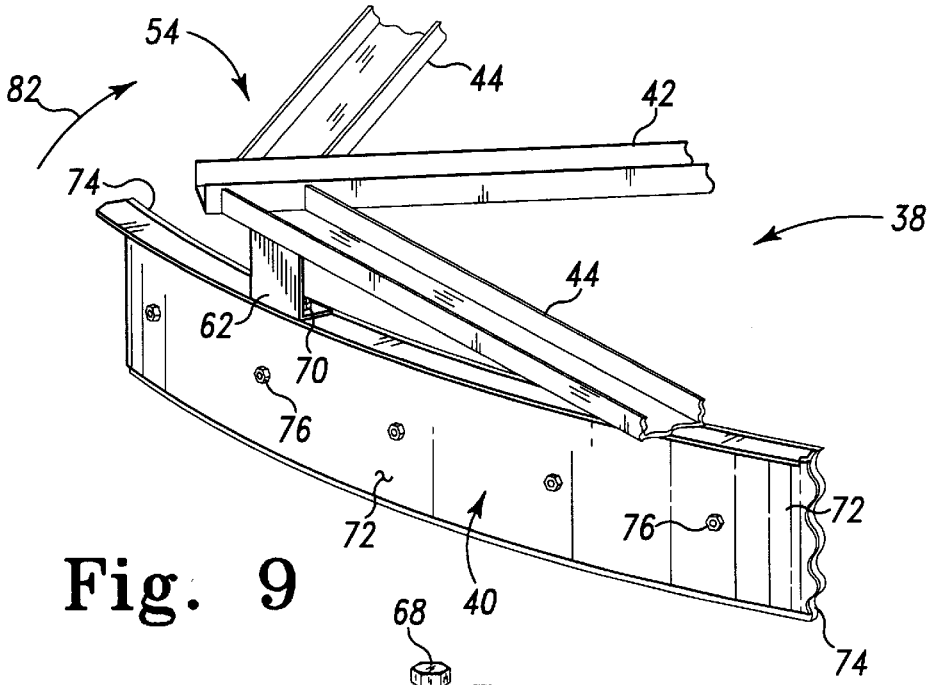
FIG. 9 is a perspective view of a portion of the floor sweep assembly of FIG. 4B showing one spacer interposed between the framework and the wiper.
Figure 10:
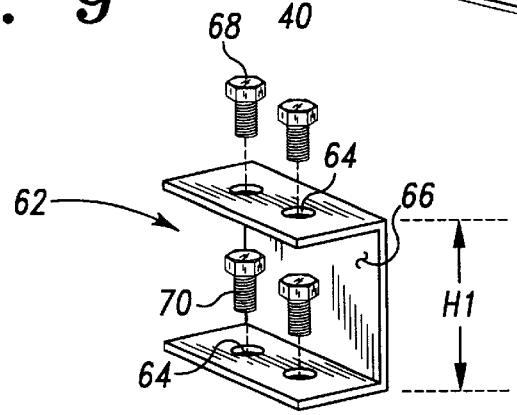
FIG. 10 is a perspective view of one of the spacers of the floor sweep assembly of FIG. 6B.

More specifically, the spacers 62 are interposed between the primary support members 42 and the wipers 40 at various primary intersections 54 in order to space the primary support members apart from the wipers 40. FIG. 9 shows a typical spacing arrangement used in this embodiment of the present invention. In particular, the spacer 62 is secured directly to the primary support member 42 with a number of fasteners 68 (see also FIG. 10). Moreover, the wiper 40 is secured directly to the spacer 62 with a number of fasteners 70.

The spacers 62 are also interposed between the ancillary support members 44 and wipers 40 at various ancillary intersections 56 in order to space the ancillary support members apart from the wipers 40. The securing of the spacers 62 at the various ancillary intersections 56 are achieved in a manner similar to that hereinbefore described with respect to securing of the spacers 62 at the various primary intersections 54.

Providing spacers 62 at various primary intersections 54 and various ancillary intersections 56 in the manner described above results in the framework 38 being spaced apart from the wipers 40 during operation the grain dryer 10. Spacing the framework 38 apart from the wipers 40 eliminates the creation of catch points between the framework 38 and wipers 40. Such catch points tend to result in plant parts such as husks, stalks, and leaves accumulating or building-up on the floor sweep assembly 28 during operation of the grain dryer 10. Accumulation of plant parts on the floor sweep assembly 28 results in a substantially increased resistance or drag being placed on the floor sweep assembly 28 during operation of the grain dryer 10 which may be detrimental to the motor 30 of the grain metering system 26. In addition, such accumulation may tend to trap a quantity of grain between such accumulation and an end portion of the wiper 40. Moving this trapped quantity of grain continuously in a recirculating path of movement also places increased resistance or drag on the floor sweep assembly 28 during operation of the grain dryer 10, as well as reducing the accuracy of the metering function performed by grain metering system 26 of the grain dryer 10.

Figure 7:
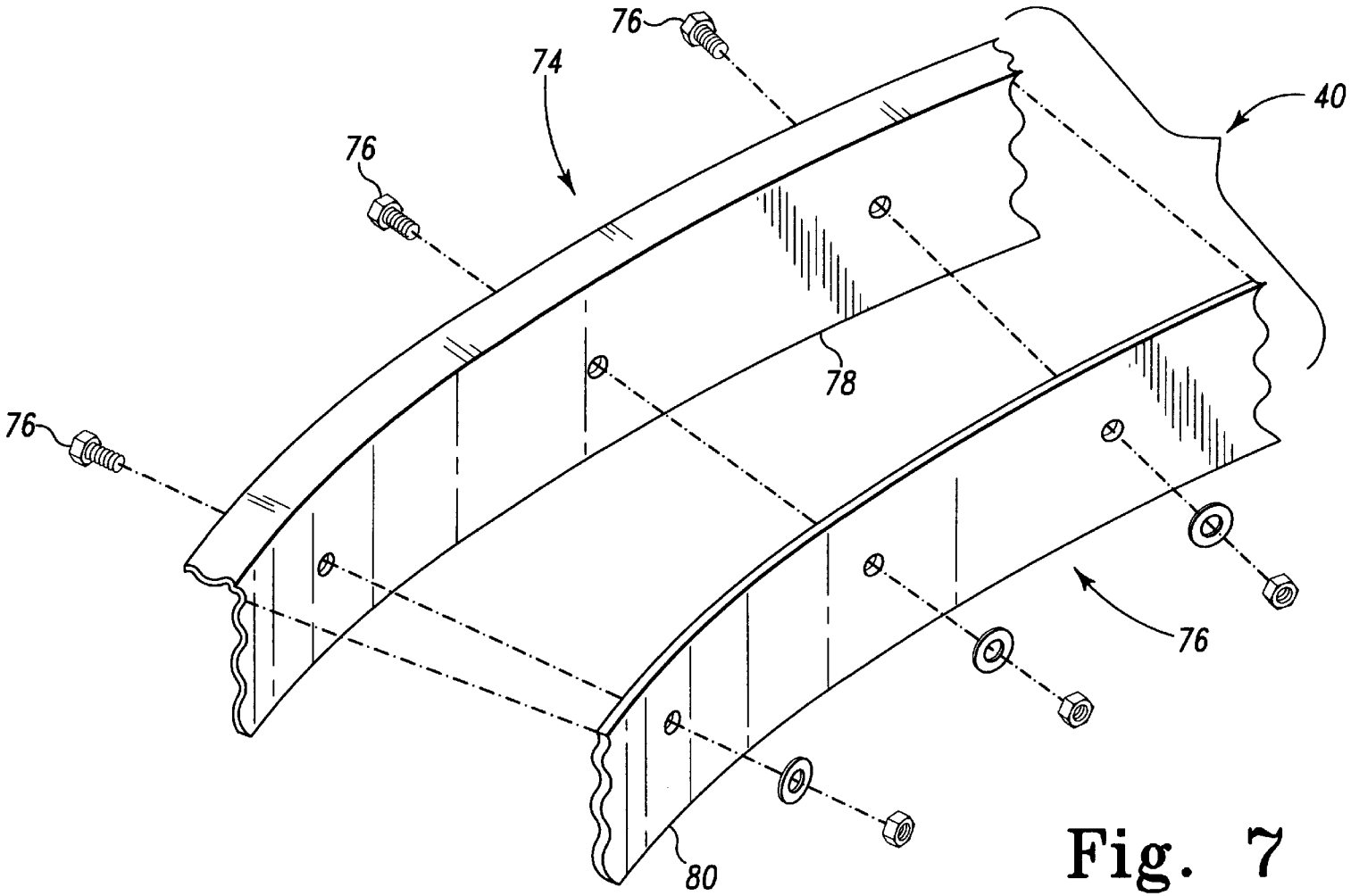
FIG. 7 is an exploded fragmentary view of one of the wipers of the floor sweep assembly of FIG. 6A.
Figure 8A:
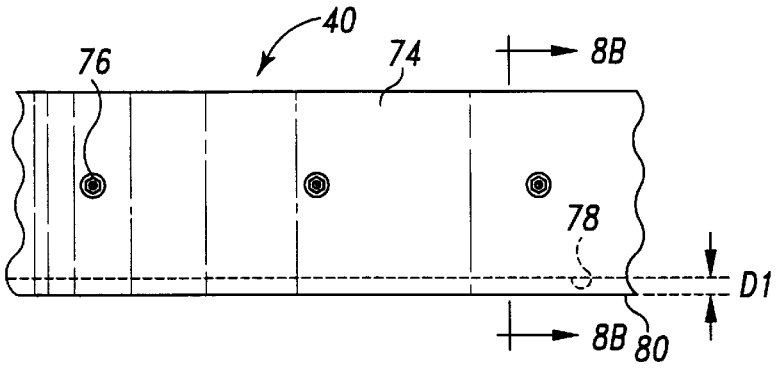
FIG. 8A is a fragmentary side elevational view one of the wipers of FIG. 6A.
Figure 8B:
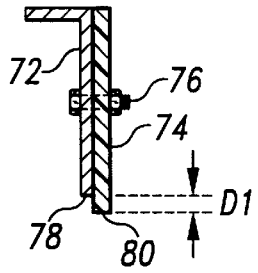
FIG. 8B is a sectional view taken along the line 8B—8B of FIG. 8A as viewed in the direction of the arrows.

The construction of the wipers 40 are shown in more detail in FIGS. 7, 8A, and 8B. In particular, each wiper 40 includes a blade support 72 and a blade 74 which is attached to the blade support 72 with a number of fasteners 76. Each of the blade supports 72 is made from formed steel. In contrast, each of the blades 74 is made from a low friction material, for example, abrasion-resistant, ultra-high molecular weight (uhmw) resin.

The blade support 72 includes a lower edge 78, while the blade 74 includes a lower edge 80. The blade 74 is secured to the blade support 72 such that the lower edge 78 of the blade support 72 is spaced a distance D1 equal to about one quarter inch (¼") vertically above the lower edge 80 of the blade 74 during operation of the grain dryer 10.

Mounting the blade 74 to the blade support 72 in the above-described manner prevents any portion of the blade support 72 from contacting the grain shelf floor 20 during operation of the grain dryer 10. This feature protects the grain shelf floor 20 from being damaged due long term frictional contact between the grain shelf floor 20 and the rotating metallic blade support 72. Note that only the lower edge 80 of the blade 74 contacts the grain shelf floor 20 during rotation of the floor sweep assembly 28. In particular, the lower edge 80 of the blade 74 contacts the grain shelf floor 20 so as to slide across the upper surface of the grain shelf floor 20 as the floor sweep assembly 28 is rotated by the motor 30. Furthermore, this feature reduces the horsepower requirements for the motor 30 of the grain metering system 26 since the blade 74, which is made of a low friction material (e.g. uhmw resin), is the only component of the grain metering system 26 which is contacting the grain shelf floor 20 during rotation of the floor sweep assembly 28.

In addition, since the blade 74 is mounted on a leading edge of the blade support 72 relative to the forward direction of movement 82 of the wiper 40 as depicted in FIG. 9, the blade 74 is advanced into contact with the grain which is supported on the grain floor shelf 20 so as to push the grain horizontally across an upper surface of the grain floor shelf. Since the low friction blade 74 is the primary component which contacts and pushes the grain across the grain floor shelf, a substantially reduced frictional resistance results from this physical contact. This feature is beneficial since it results in a significantly reduced amount of physical trauma to the grain during advancement of the grain from the outer peripheral edges of the grain shelf floor 20 to the hopper 17 during the grain metering process. This feature is additionally beneficial because it further reduces the horsepower requirements for the motor 30 of the grain metering system 26 since the blade 74 which is made of a low friction material (e.g. uhmw resin) is the primary component of the grain metering system 26 which is contacting the grain during rotation of the floor sweep assembly 28.

While the invention has been described in detail in the drawings and foregoing description, the same is to be considered as illustrative and not restrictive in character, it being understood that only the preferred embodiments and methods have been shown and described and that all changes and modifications that come within the spirit of the invention are desired to be protected.

What is claimed is:

1. A floor sweep assembly for a grain dryer, comprising:

a framework which is rotatable around a central axis;

a wiper positioned relative to said framework such that, when said floor sweep assembly is viewed in a plan view, said framework defines a first intersection with said wiper; and a first spacer attached to both said framework and said wiper in a manner which causes said framework to be spaced apart from said wiper.

2. The assembly of claim 1, wherein:

said framework includes a first primary support member which extends radially outwardly relative to said central axis, said first primary support member is positioned relative to said wiper such that, when said floor sweep assembly is viewed in said plan view, said first primary support member defines said first intersection with said wiper, said first spacer is interposed between said first primary support member and said wiper;

said first spacer is attached to said first primary support member, said wiper is attached to said first spacer, and said first primary support member is located vertically above said wiper.

3. The assembly of claim 1, further comprising a second spacer, wherein:

said framework includes (i) a first primary support member which extends radially outwardly relative to said central axis, (ii) a second primary support member which extends radially outwardly relative to said central axis, and (iii) an ancillary support member which is spaced apart from said central axis and extends between said first primary support member and said second primary support member, said first primary support member is positioned relative to said wiper such that, when said floor sweep assembly is viewed in said plan view, said first primary support member defines said first intersection with said wiper, said ancillary support member is positioned relative to said wiper such that, when said floor sweep assembly is viewed in said plan view, said ancillary support member defines a second intersection with said wiper, said first spacer is further attached to said first primary support member and said wiper in a manner which causes said first primary support member to be spaced apart from said wiper, and said second spacer is attached to said ancillary support member and said wiper in a manner which causes said ancillary support member to be spaced apart from said wiper.

4. The assembly of claim 1, wherein:

X=the closest distance between said framework and said wiper, and

X>2.0 inches.

5. The assembly of claim 1, wherein no portion of said wiper contacts said framework.

6. The assembly of claim 1, wherein:

said first spacer is attached to said framework with a number of first fasteners, and said wiper is attached to said first spacer with a number of second fasteners.

7. A floor sweep and motor assembly for a grain dryer, comprising:

a motor;

a support member which is driven by said motor;

a wiper positioned relative to said support member such that, when said support member and said wiper are viewed in a plan view, said support member defines an intersection with said wiper; and a spacer attached to both said support member and said wiper in a manner which causes said support member to be spaced apart from said wiper.

8. The assembly of claim 7, wherein:

said spacer is interposed between said support member and said wiper, and said support member is located vertically above said wiper.

9. The assembly of claim 8, wherein:

said spacer is attached to said support member with a number of first fasteners, and said wiper is attached to said spacer with a number of second fasteners.

10. The assembly of claim 7, wherein:

said motor drives said support member around a central axis, and said support member extends radially outwardly relative to said central axis.

11. The assembly of claim 7, wherein:

X=the closest distance between said support member and said wiper, and

X>2.0 inches.

12. The assembly of claim 7, wherein no portion of said wiper contacts said support member.

13. A method of advancing grain in a grain dryer with a floor sweep assembly, with (i) the floor sweep assembly including a support member and a wiper, and (ii) the wiper being positioned relative to the support member such that, when the floor sweep assembly is viewed in a plan view, the support member defines an intersection with said wiper, comprising the steps of:

rotating the floor sweep assembly so that the support member and the wiper are rotated in a path of movement; and maintaining a space between the support member and the wiper at the intersection such that no portion of the wiper contacts the support member during the rotating step.

14. The method of claim 13, further comprising the step of:

advancing grain into the path of movement so that the wiper contacts the grain during the rotating step.

15. The method of claim 14, wherein:

the grain dryer further includes (i) a grain shelf floor having a hopper opening defined therein, and (ii) a wall having a grain drying space defined therein;

the advancing step includes the step of advancing the grain from the grain drying space onto the grain shelf floor; and the rotating step includes the step of pushing the grain on the grain shelf floor with the wiper until the grain falls through the hopper opening.

16. The method of claim 15, wherein:

the grain dryer further includes a motor, and the rotating step includes the step of rotating the floor sweep assembly in the path of movement with the motor.

17. The method of claim 13, wherein:

X=the closest distance between the support member and the wiper, and

X>2.0 inches.

18. A floor sweep assembly for a grain dryer, comprising:

a framework which is rotatable around a central axis, wherein said framework includes (i) a first primary support member which extends radially outwardly relative to said central axis, (ii) a second primary support member which extends radially outwardly relative to said central axis, and (iii) an ancillary support member which is spaced apart from said central axis and extends between said first primary support member and said second primary support member;

a wiper positioned relative to said framework such that, when said floor sweep assembly is viewed in a plan view, said framework and said wiper define (i) a primary intersection of said wiper and said first primary support member, and (ii) an ancillary intersection of said wiper and said ancillary support member;

a first spacer attached to said first primary support member and said wiper in a manner which causes said first primary support member to be spaced apart from said wiper, and a second spacer attached to said ancillary support member and said wiper in a manner which causes said ancillary support member to be spaced apart from said wiper.

19. The assembly of claim 18, wherein:

said first primary support member is located vertically above said wiper, and said ancillary support member is located vertically above said wiper.

20. The assembly of claim 18, wherein:

X=the closest distance between said framework and said wiper, and

X>2.0 inches.

21. The assembly of claim 18, wherein no portion of said wiper contacts said framework.

22. A grain dryer, comprising:

a wall assembly having (i) an inner wall and an outer wall which defines a grain flow path therebetween, and (ii) a discharge slot defined in said wall assembly through which grain may flow;

a grain shelf floor positioned relative to said wall assembly such that grain flowing through said discharge slot advances onto said grain shelf floor;

a floor sweep assembly positioned vertically above said grain shelf floor, said floor sweep assembly having (i) a support member, and (ii) a wiper positioned relative to said support member such that, when said floor sweep assembly is viewed in a plan view, said support member defines an intersection with said wiper;

a motor for rotating said floor sweep assembly about a central axis; and a spacer attached to both said support member and said wiper in a manner which causes said support member to be spaced apart from said wiper.

23. The assembly of claim 22, wherein said support member is located vertically above said wiper.

24. The assembly of claim 22, wherein:

X=the closest distance between said support member and said wiper, and

X>2.0 inches.

25. The assembly of claim 22, wherein no portion of said wiper contacts said support member.

* * * * *

UNITED STATES PATENT AND TRADEMARK OFFICE

CERTIFICATE OF CORRECTION

PATENT NO. : 6,073,367
APPLICATION NO. : 09/124307
DATED : June 13, 2000
INVENTOR(S) : Terry L. McKenzie, Paul W. Peterson and Wesley L. Peterson It is certified that error appears in the above-identified patent and that said Letters Patent is hereby corrected as shown below:

On the front page, within the bibliographic information, please delete:

"Related U.S. Application Data
Provisional application No. 60/054,171, Jul. 30, 1997."

In column 1, lines 8-9 of the specification, please delete the sentence:

"This Appln. claims benefit of Provisional Appln. 60/054,171 July 30, 1997."

Signed and Sealed this

Eighteenth Day of December, 2007

JON W. DUDAS
*Director of the United States Patent and Trademark Office*